US005262585A

United States Patent [19]

Greene et al.

[11] Patent Number: 5,262,585

[45] Date of Patent: Nov. 16, 1993

[54] ELECTRONIC CYMBAL SYSTEM

[75] Inventors: Lenny Greene, Studio City; Michael W. Smith, Glendale, both of Calif.

[73] Assignee: Lenny Greene, Studio City, Calif.

[21] Appl. No.: 852,707

[22] Filed: Mar. 17, 1992

Related U.S. Application Data

[63] Continuation-in-part of Ser. No. 606,575, Oct. 31, 1990.

[51] Int. Cl.[5] ..... G10M 3/00

[52] U.S. Cl. ..... 84/645; 84/DIG. 12; 84/DIG. 24; 84/723; 84/738

[58] Field of Search ..... 84/DIG. 12, DIG. 24, 84/645, 723, 730, 737, 738, 743, 421

[56] References Cited

U.S. PATENT DOCUMENTS

| | | | |
|---|---|---|---|
| 4,700,602 | 10/1987 | Bozzio | 84/DIG. 24 |
| 4,753,146 | 6/1988 | Seiler | 84/DIG. 12 |
| 4,867,028 | 9/1989 | Jones | 84/DIG. 12 |
| 5,042,356 | 8/1991 | Karch | 84/743 |
| 5,076,131 | 12/1991 | Patterson | 84/421 |

*Primary Examiner*—William M. Shoop, Jr.

*Assistant Examiner*—Helen Kim

[57] ABSTRACT

The cymbal system comprises a cymbal member mountable on a cymbal stand, the cymbal member having a playing feel approximating that of a conventional cymbal. A transducer is affixed to a surface of the cymbal member for translating any substantial percussive impact on the cymbal member to electrical signals. These electrical signals are converted into MIDI "note-on" messages serving as trigger messages. At least one conductive element is mounted on the cymbal member. A MIDI interface system is included which detects the alternation in an electrical signal between two stable states in response to a user's manipulation of the conductive element, each stable state representing a digital signal. The MIDI interface system also includes a software system for recognizing and then interpreting the digital signal into MIDI SYSEX messages, or note off and note on messages, serving as MIDI choke/send messages. The trigger messages and the choke/send messages are sent out via a MIDI connection to an external tone generating device.

15 Claims, 10 Drawing Sheets

ELECTRONIC CYMBAL SYSTEM

This is a continuation-in-part of application Ser. No. 07/606,575, filed Oct. 31, 1990.

BACKGROUND OF THE INVENTION

1. Field of the Invention

The present invention relates to electronic and digital musical instruments and more particularly to an electronic cymbal system using a cymbal member with a transducer attached thereto, and a MIDI interface system for emulating the playing feel of a conventional cymbal.

2. Description of the Related Art

Over the years, electronic musical instruments have become increasingly popular in the music industry for both recording and performance purposes. Typically, to obtain an electronically produced percussion sound (or other type of musical or digitally encoded tone), performers strike pads containing impact sensitive pickup devices, such as transducers. These transducers respond to varying levels of percussive intensities exerted by the performer. Electrical impulses are translated into electronically produced sounds by a digital tone source, typically a MIDI (musical instrument digital interface). Dynamic nuances in the performance are provided as a result of proportional changes in the current.

Prior art electronic drum pad systems typically employ a rigidly mounted pad in various shapes (usually pentagonal to octagonal, or round). Most employ a conventional type acoustic tom-tom drum mount for mounting on a conventional tom-tom or drum stand. Thus, once adjusted, they are committed to a fixed and rigid playing position.

This technology works well for simulating the feel of acoustic tom-tom, snare, & even bass drums, as illustrated in U.S. Pat. No. 4,700,602, however, it cannot satisfactorily simulate the playing feel of real (acoustic) cymbals. In addition, it may be necessary, for one using such prior electronic drum systems, to obtain a particular type or brand of compatible drum stands in order to properly accommodate the mounting of these electronic drums.

SUMMARY OF THE INVENTION

The present invention is an electronic cymbal system which, in one broad aspect, comprises a semi-rigid resilient disc and a sound pickup device affixed to a surface of the disc. The disc includes a centrally disposed hole for mounting the disk on a conventional cymbal stand. It has a diameter and playing feel approximating that of a conventional cymbal. The sound pickup device translates any significant percussive impact on the disc to electrical signals. The signals are used to trigger sounds from an external tone generating device.

In another broad aspect, the cymbal system comprises a cymbal member mountable on a cymbal stand, the cymbal member having a playing feel approximating that of a conventional cymbal. A transducer is affixed to a surface of the cymbal member for translating any substantial percussive impact on the cymbal member to electrical signals. These electrical signals are converted into MIDI "note-on" messages serving as trigger messages. At least one conductive element is mounted on the cymbal member. A MIDI interface system is included which detects the alternation in an electrical signal between two stable states in response to a user's manipulation of the conductive element, each stable state representing a digital signal. The MIDI interface system also includes a software system for recognizing and then interpreting the digital signal into MIDI SYSEX messages, or note off and note on messages, serving as MIDI choke/send messages. The trigger messages and the choke/send messages are sent out via a MIDI connection to an external tone generating device.

The term transducer or sound pickup device may include, for example, a pressure transducer (i.e. piezoelectric transducer) or force sensing resistor. As used herein, the term "semi-rigid resilient disc" refers to a disc that has sufficient rigidity to maintain its structural integrity upon repeated impact by a drummer's stick. It emulates the playing feel of a conventional cymbal by its comparable weight, mass, size, and percussive responsiveness. In this regard, ABS plastics are preferred. The external tone generating device may be, for example, a drum machine or module, a synthesizer or module, or, a digital sampling keyboard or module. A pad to trigger MIDI interface is generally used to connect the pickup devices to these external tone generating devices.

The MIDI interface system cooperates with conductive elements mounted on the cymbal member, which are at locations easily accessible to the user's touch, to provide a "choke-off" of the sound. "Choke-off" is activated when the user bridges the conductive elements with his touch. The decay time of a crash or ride cymbal tone generated by the system is cut before the tone reaches its full and normal decay period. Alternately a tone can be played by the user bridging the conductive elements with his touch.

In one embodiment, a second, relatively small, semi-rigid resilient disc and respective pressure transducer are mounted on the conventionally sized semi-rigid resilient disc. The second semi-rigid resilient disc has a diameter approximating that of a bell portion of a conventional cymbal to emulate the feel and positioning of the bell portion of a conventional cymbal.

The principles of the present invention may be extended for use as a novel electronic hi-hat cymbal system. In such an application a conventionally sized semi-rigid resilient cymbal member having a pickup device (i.e. pressure transducer) affixed thereto, constructed in accordance with the principles of the present invention, forms an upper electronic cymbal of a pair of electronic hi-hat cymbals. A lower electronic cymbal of the pair of electronic hi-hat cymbals is formed of a second semi-rigid resilient cymbal member.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1A:
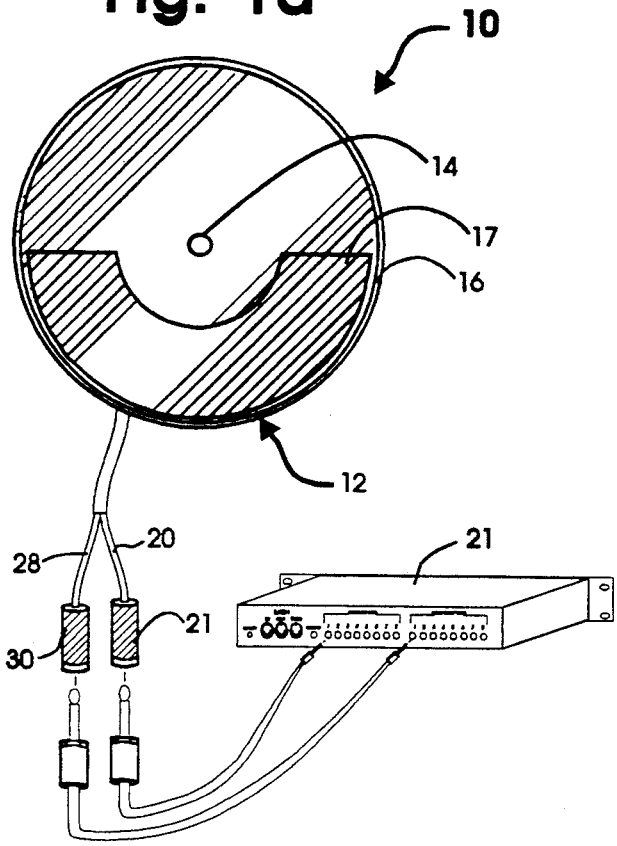
FIG. 1*a* is a top view of a cymbal member of a basic embodiment of the electronic cymbal system of the present invention.

Referring to the drawings and the characters of reference marked thereon, FIG. 1*a* illustrates a basic embodiment of the electronic cymbal system of the present invention, designated generally as 10. Electronic cymbal system 10 includes a cymbal member, preferably in the form of a resilient disc 12 having the approximate weight, mass, and diameter of a conventional cymbal. It typically has a diameter ranging from five inches to thirty inches. Disc 12 is preferably formed of ¼" ABS plastic. However, it may be formed of, for example, 1/32"–⅛" plastic which may be laminated to wood or masonite. Or, it may be formed of acrylic, or another suitable impact resistant material which does not produce an acoustically ringing sound similar to that of an actual cymbal. It is preferred that the disc be formed of material sufficiently resilient to properly simulate the feel of striking a real cymbal with a drum stick and to withstand repeated impact without breakage. For this reason, ABS plastic is preferred.

The center of the disc 12 preferably includes a hole 14 (approx. one-half inch in diameter) for mounting the electronic cymbal on any standard (commercially available) cymbal stand. Disc 12 also preferably has a bevelled edge 16 on the upper surface of its outer periphery. The purpose of this bevelled edge 16 (approx. ⅛–⅜" depth of curvature) is to minimize the abrasiveness of the edge of the disc as seen by the common drum stick (conventionally used to play cymbals). This feature is especially advantageous when the "sticking" technique of striking the shoulder of the drum stick against the edge of the cymbal is used for the purpose of "crashing". This bevelled surface 16 creates a more palatable playing feel and it increases the playing life of a player's drum sticks. A rubber pad 17 is preferably used to provide a comfortable playing surface.

Figure 1B:
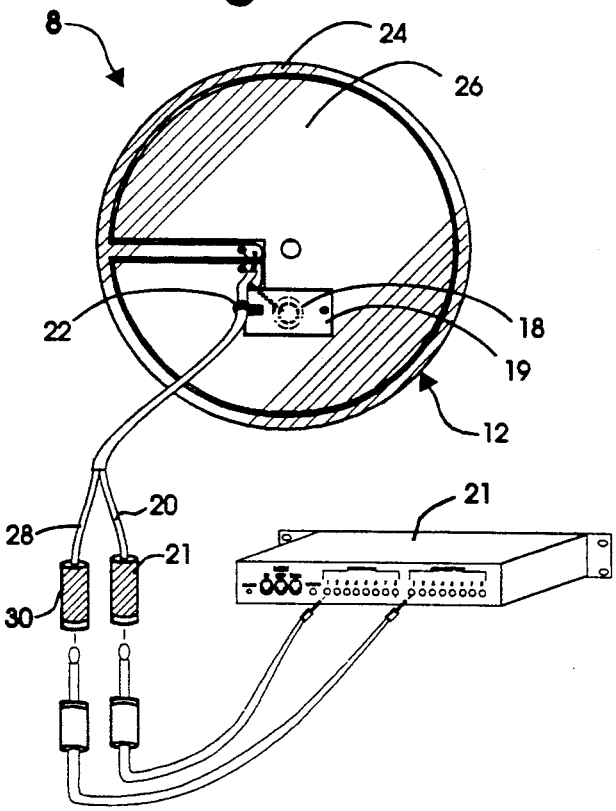
FIG. 1*b* is a bottom view of the electronic cymbal system of FIG. 1*a*.

FIG. 1*b* illustrates the bottom surface of the disc 12. A pressure transducer, preferably a piezoelectric transducer 18, is affixed to this surface. Although piezoelectric transducers are preferred, other alternate commercially available pickup devices may be used, such as those manufactured by Barcus Berry Co.

The transducer 18 may be flush or semi-flush mounted into the bottom surface of the disc 12. It is glued to the disc 18 with a double adhesive and/or a rubbery cement compound. A coverplate 19 is provided which is secured by screws.

A cord, extending from transducer 18, terminates with, preferably, a standard ¼" female in-line phone jack 21 to facilitate easy hookup to a MIDI interface system 21. (Preferably, the cord actually includes two lined cords 20, 28, one to the transducer 18 and a second for the choke circuitry which will be explained in detail below.) A strain relief 22 is provided to maintain the cord 20 in the correct position and resistant to shorting during movement. Strain relief 22 is preferably made of nylon, plastic, or metal and is affixed by screws mounted over the cord. Cord 20 may typically be a two conductor type cord about 2–3 feet long.

A thin outer conductive plane element 24 and a thin inner conductive plane element 26 are affixed to the bottom surface of the disc 12. Elements 24,26 are each attached to the bottom surface of the disc 12, preferably by means of contact cement or some form of industrial or epoxy adhesive. Element 24 is disposed adjacent to the outer periphery of the disc 12. Inner element 26 is positioned slightly separately from outer element 24 and interiorly therefrom. Elements 24 and 26 serve as a conductive device when bridged by the hand or finger(s) of a performer. This action will, in turn, cause an electrical circuit (described below), to send a signal to the host digital drum unit (not shown) to "choke-off" (stop) the normal ringing sound of a crash or ride cymbal sound before it reaches its normal and full decay period. This innovation brings a new dimension of reality to the playing feel of an electronic cymbal. Real cymbals are often "choked-off" for enhanced musical performance dynamics. Conductive elements 24,26 may be formed of tin, copper, brass, or other highly conductive metal. The gauge should be sufficiently thin so as not to be obtrusive to the touch. The second two line cord 28 and jack 30 is wired to the two independently mounted conductive elements 24,26.

Figure 2:
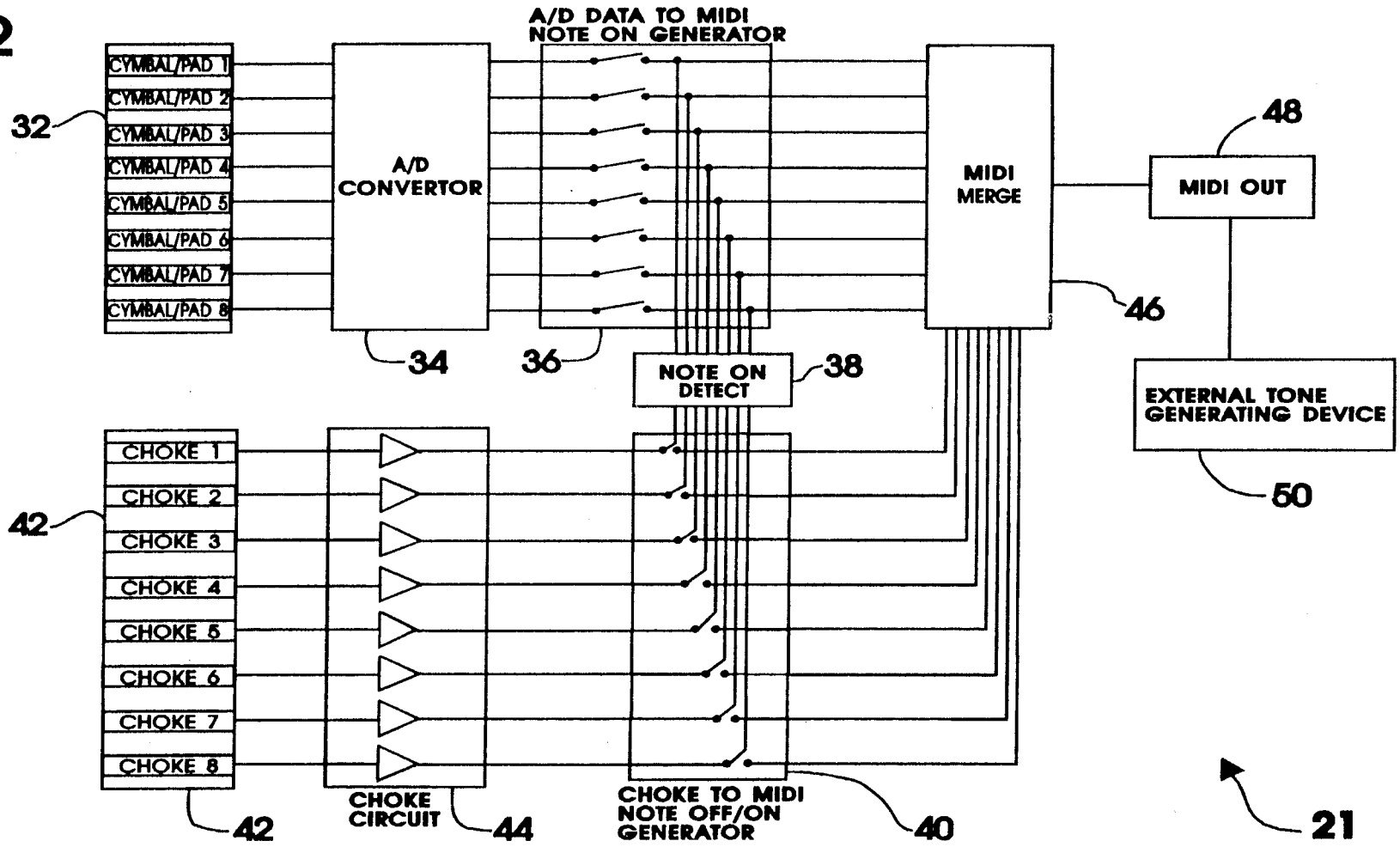
FIG. 2 is a block schematic diagram of a MIDI interface system, in accordance with the principles of the present invention.

Referring now to FIG. 2, a block schematic diagram of a MIDI interface system in accordance with the principles of the present invention, is illustrated. Cymbal/pad inputs 32 (1–8) (one of these which, for example could correspond to jack 21 in FIG. 1), are connected to the outputs of the electronic percussion trigger pads (i.e. pressure transducers and their outputs). Eight pads are shown for illustrative purposes only. The number of trigger pads utilized is dependent upon the desired ultimate purpose. For example, a multitude of trigger pads would be used to simulate a full kit of conventional cymbals commonly used by a drummer. The cymbal/pads input changes in voltage, preferably 0–5 volts, which is then translated into digital data by an analog to digital converter 34. The A/D converter 34 then sends the data into an appropriate microprocessor. The microprocessor may be, for example, an Intel 8051 type microprocessor. The data is software recognition interpreted, by a software system illustrated by A/D data to MIDI note on generator 36, note on detect 38, and/or a choke to MIDI note off generator 40.

The choke inputs 42 (1–8) are typically connected to choke output jacks (one of these which, for example, could correspond to jack 30 in FIG. 1). (The choke has normally open conductive contacts.) Each choke input 42 is connected to an individual choke circuit. Eight individual choke circuits are illustrated in group block form, as choke circuit 44. The outputs of buffering amplifiers in each choke circuit is directed into the microprocessor which, through software recognition (blocks 36, 38, 40), can flag and interpret the voltage outputs of the choke circuit as MIDI choke/send messages (either MIDI note on or off). Typically, a note off message is generated and is used to turn off a sound that was triggered by a MIDI note on message from the cymbal/pad inputs 32.

The desired MIDI message can be generated by the software system upon reception of a voltage level corresponding to closed choke contacts, or of a voltage level corresponding to open contacts. The present invention, as illustrated in FIG. 2, typically generates a MIDI note off message when the choke contacts are closed and takes no action when the contacts are open. However, it can also be instructed to send MIDI note on messages when the choke circuit contacts are closed and take no action when they are opened in addition to being able to send note on and note off messages when the contacts are opened.

Ultimately, the outputted data from portions 36, 40 are software merged into MIDI out data, as illustrated by MIDI merge 46 and then sent to MIDI out 48, typically connected to an external MIDI sound generator 50 via a MIDI cable.

Each choke circuit 44, in its broadest aspects, comprises a switch that is either closed or open. This switch can be closed via skin resistance between two contacts (as in the conductive elements 24,26 shown in FIG. 1) or by mechanical closing of the contacts, as in a high-hat embodiment (illustrated by reference to FIG. 6). The closing of this switch is translated into a MIDI note off data message as specified in the MIDI protocol.

Figure 3A:
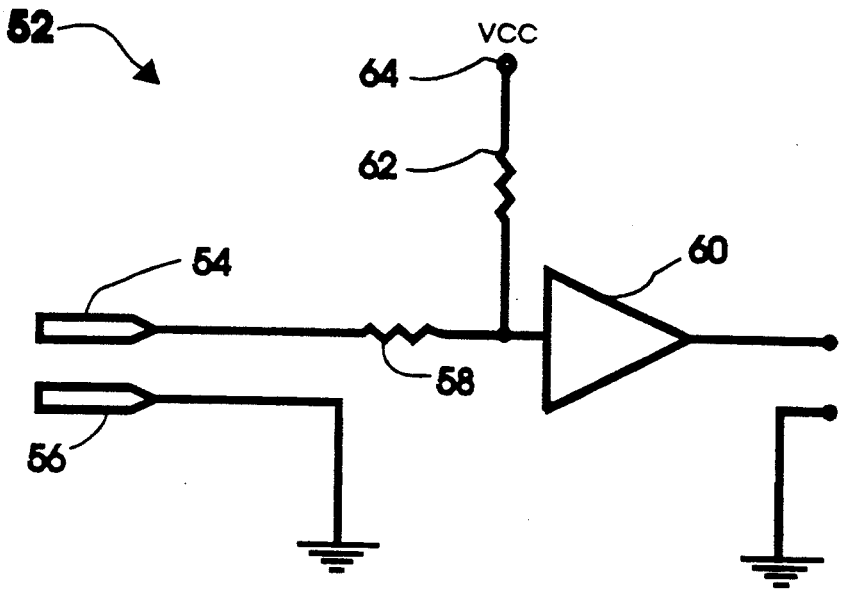
FIG. 3*a* is a schematic illustration of a ground referenced switch which may be implemented as a choke circuit for use with the present electronic cymbal system.

To sense the closing of the contacts by skin resistance, a high impedance switch circuit must be used to allow sensing of the closed contacts by skin. FIG. 3*a* illustrates a preferred embodiment of such a high impedance switch circuit, comprising a ground referenced floating switch, designated generally as 52. Ground referenced floating switch 52 comprises a first contact 56 connected to one of the conductive elements shown in FIG. 1*b* and a second contact 54 connected to the other conductive element. A low impedance resistance means 58 is connected in series between the second contact 54 and the input of a buffering amplifier 60. A high impedance resistance means 62 is connected in series between a power supply 64 and the input of the buffering amplifier 60. (High impedance resistance means should be in a range between 4.7 to 22 megohms, preferably about 22 megohms.) Typically, skin resistance is on the order 200K ohms/inch or greater, depending on the amount of moisture on the skin.

Use of a high impedance circuit for the switch necessitates using the buffering amplifier 60 to translate the low current switch signals into high current signals that can be utilized by the rest of the circuitry. The buffering amplifier 60 can be any device with a high input impedance such as a Darlington Bipolar Transistor, a Jfet Transistor, a Mosfet Transistor, an operational amplifier integrated circuit with Jfet inputs, an operational amplifier integrated circuit with Mosfet inputs, or a logic integrated circuit with Mosfet inputs. Preferably, a logic integrated circuit with Mosfet inputs is employed. To prevent static damage to the buffering amplifier 60 inputs, the resistor 58 is placed in series between the floating switch contact 54 and the buffering amplifier 60 input. (The value of this resistor 58 should be in a range between 0–470K ohms, typically around 100K ohms.)

Figure 3B:
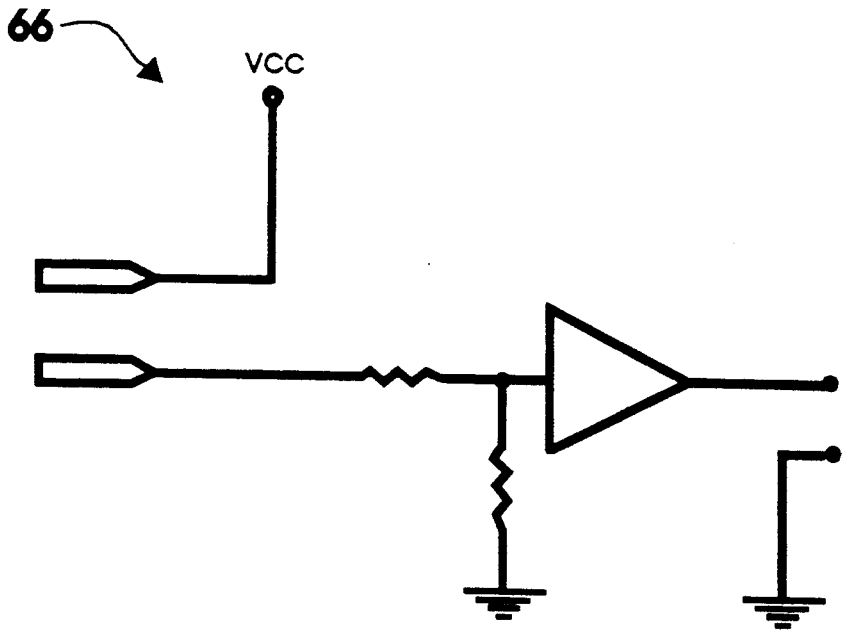
FIG. 3*b* is a schematic illustration of a VCC referenced switch with may be implemented as such a choke circuit.

There are two poles the choke circuit can be closed to: from the floating switch contact that is at ground potential to power supply; or from the floating switch contact that is at power supply to ground. The preferred choke circuit illustrated in FIG. 3*a* closes the floating switch contact at power supply potential to ground. To set the floating point switch contact at power supply potential, the contact is connected to power supply by the high impedance resistance means. FIG. 3*b* illustrates such a VCC referenced switch, designated generally 66. To translate the closing of the switch into a MIDI note off message, the microprocessor is used to sense the voltage levels of the buffering amplifier 60. When the microprocessor receives a voltage level from the buffering amplifier 60 that corresponds to the closing of the switch contacts 54, 56, it typically generates a MIDI note off message. This MIDI note off message is used to turn off a sound in the sound generator 50 that was triggered by a MIDI note on trigger message from a pad interface portion of the MIDI interface system.

Any MIDI message can be generated by the microprocessor upon reception of a voltage level corresponding to closed contacts, or a voltage level corresponding to open contacts (i.e. an electrical signal is alternated between two stable states). The preferred embodiment generates a MIDI note off message when the choke circuits contacts are closed and takes no action when the contacts are opened. However, the system can be also instructed to send MIDI note on messages when the choke circuit contacts are closed and take no action when they are opened in addition to being able to send note on and note off messages when the contacts are opened.

The microprocessor in the MIDI interface system can control all aspects of translation of voltage signals and switch contact actions to MIDI data according to the MIDI protocol. A typical sequence of events is as follows:

1. A cymbal member is struck generating a voltage signal from the piezo-electric transducer.
2. The MIDI interface system receives that voltage signal and translates the level into a MIDI note on message with a corresponding velocity data.
3. The MIDI note on message is sent to a drum machine sound generator which turns on a sound.
4. The choke is activated by placing the hand across the switch contacts. This is typically done by grabbing the cymbal.
5. The buffer amplifier translates the low current voltage signal from the switch into a high current voltage signal.
6. The MIDI interface system translates the level of the high current voltage signal into a MIDI note off message.
7. The MIDI note off message is sent to the drum machine sound generator which turns off the sound previously turned on by the MIDI note on message.

It is noted that, instead of the choke circuit specifically described, other means may be provided for establishing a digital signal to be used by the software system. For example, RF tuned circuits and proximity detector circuits may be utilized in conjunction with at least one conductive element as means for alternating an electrical signal between two stable states in response to a user's manipulation of that conductive element, each stable state representing the desired digital signal.

Figure 4:
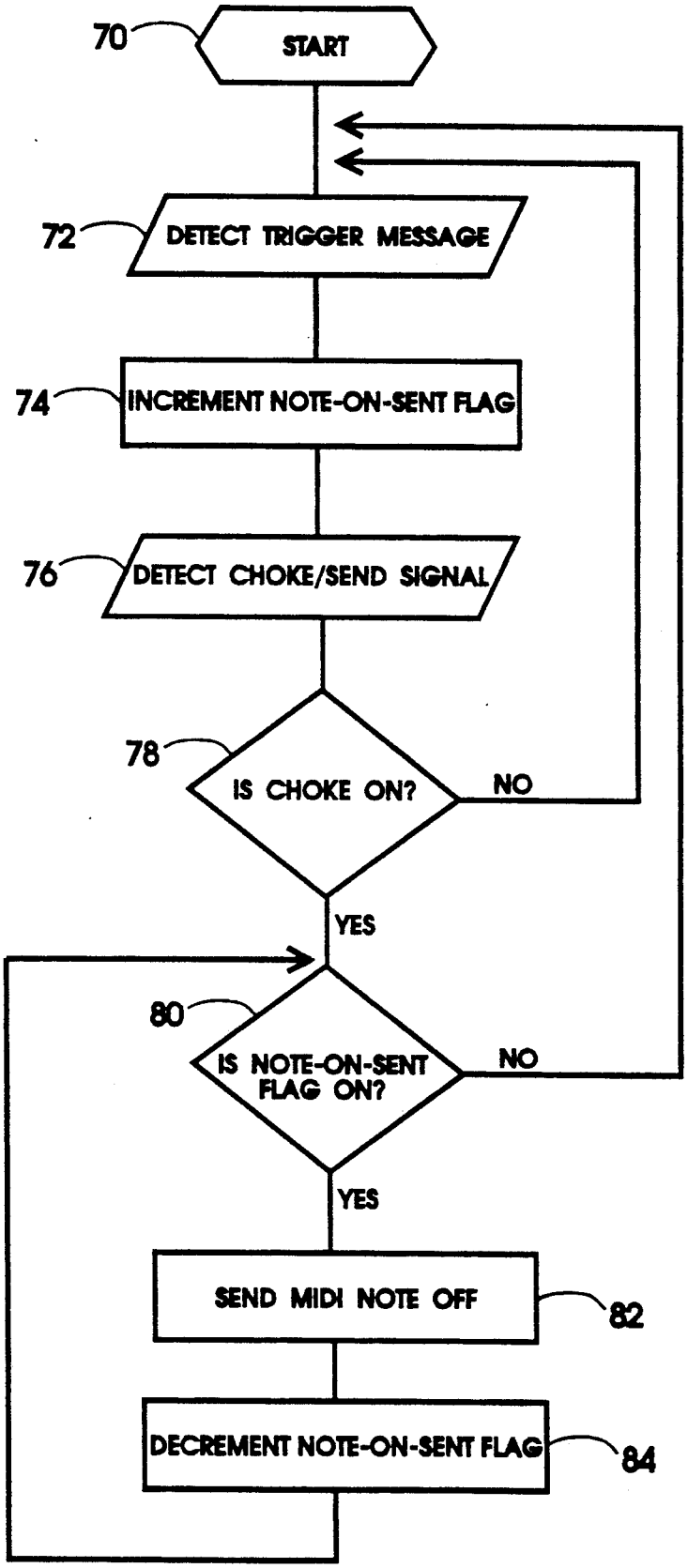
FIG. 4 is a flow chart illustrating the manner in which the MIDI interface system interprets digital choke/send messages.

Referring now to FIG. 4, an algorithm is shown which illustrates the manner in which the MIDI interface system 21 interprets digital choke-send messages. At start (block 70) the MIDI interface system is waiting for an incoming trigger message (block 72) from the pad interface, originating from a pressure transducer. A note on sent flag is incremented (block 74). Block 76 detects whether a choke/send signal is present. There is a return to start if the choke/send signal is not on (block 78) there is a return to start if the note on sent flag is not on (block 80). If note on sent flag is on, a corresponding MIDI note off is sent (block 82). The note on sent flag is then decremented. There is then a return to block 80 to determine whether any note on sent flags are still on. This algorithm allows for polyphonic triggering of note on and note off information. System exclusive (SYSEX) messages are codes that are used to perform instrument specific functions and operations that don't fall under the realm of Voice, Mode, Common, and Real-Time MIDI messages defined by the MIDI protocol. These SYSEX messages can alternatively be used to achieve the same results that the MIDI note on and note off messages effect in a tone generating device.

Figure 5:
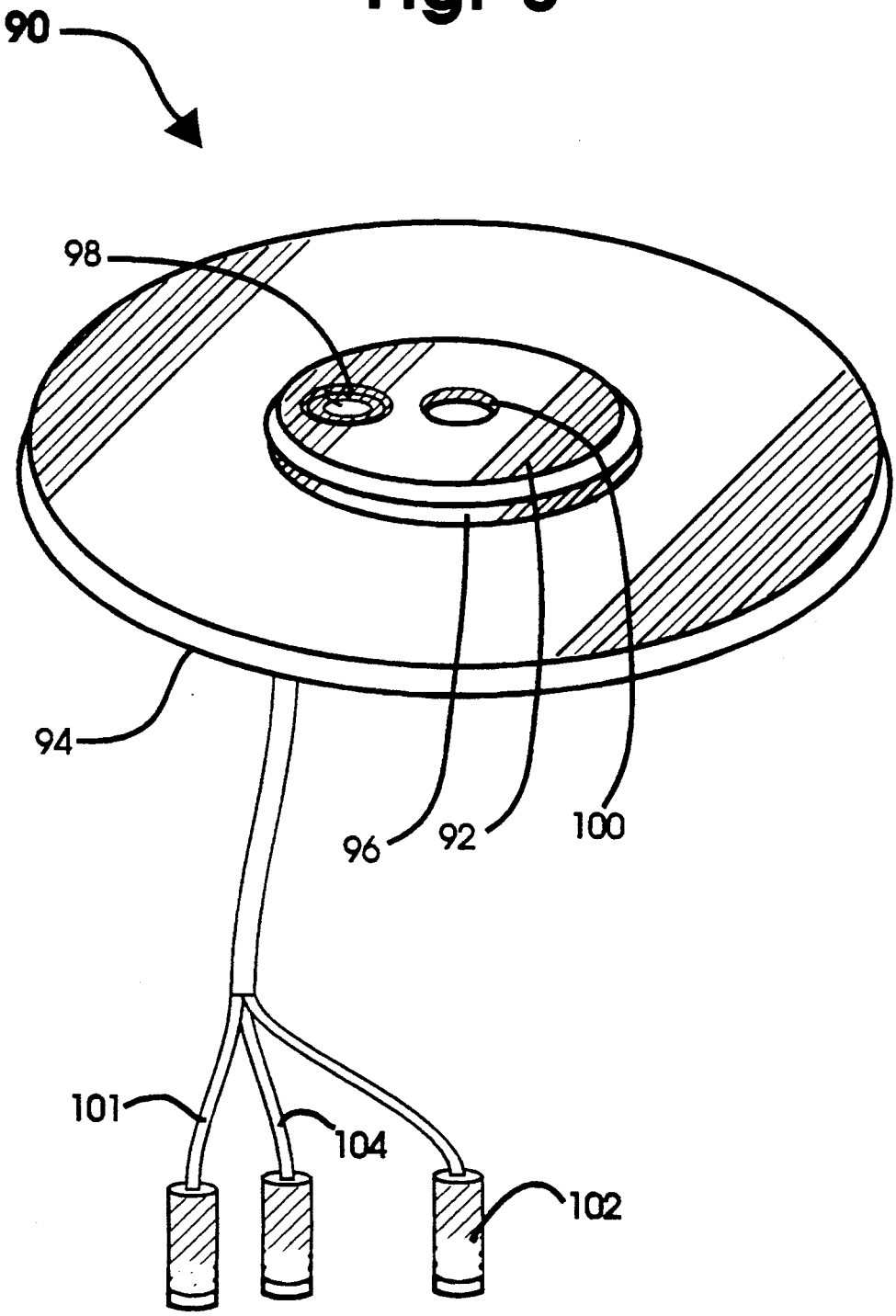
FIG. 5 is an angled side perspective view of another embodiment, illustrating the use of an additional striking element for emulating the feel and positioning of the bell portion of a conventional cymbal.

FIG. 5 illustrates an electronic cymbal, designated generally as 90, in which the feel of the bell portion of an acoustic ride or crash cymbal may be emulated. A relatively small disc 92, of similar material as the disc discussed in the previous embodiment (FIG. 1), is mounted above a disc 94 having the same size as the cymbal of the previous embodiments. A piece of neoprene rubber 96 is sandwiched between small disc 92 and larger disc 94. Affixation of the sandwich is preferably provided by use of an industrial strength double adhesive or other sufficient rubbery cement.

As can be seen in FIG. 5, an additional transducer 98 is countersunk mounted in the bottom side of the upper, small disc 92. A hole 100 in the upper disc 92 is to allow for unobstructed mounting on a conventional cymbal stand. A hole is also provided in lower disc 94 (not shown) to allow passage of an electrical connection from transducer 98 to a jack 102.

This configuration provides shock isolation to the top mounted transducer 98 from a transducer positioned on the bottom surface of disc 94. The bottom surface of the disc 94 appears the same as the surface illustrated in FIG. 1*b*, including the conductive elements which serve as part of the choke switch. A choke cord is designated 101. (Obviously, the transducer on the bottom cannot be seen in these figures, however its cord 104 is shown.) A small disc 92 serves as an additional playing surface for the performer which can adequately simulate the feel of the bell part of an actual acoustic ride cymbal. In this respect, it should be sized and positioned accordingly.

Figure 6A:
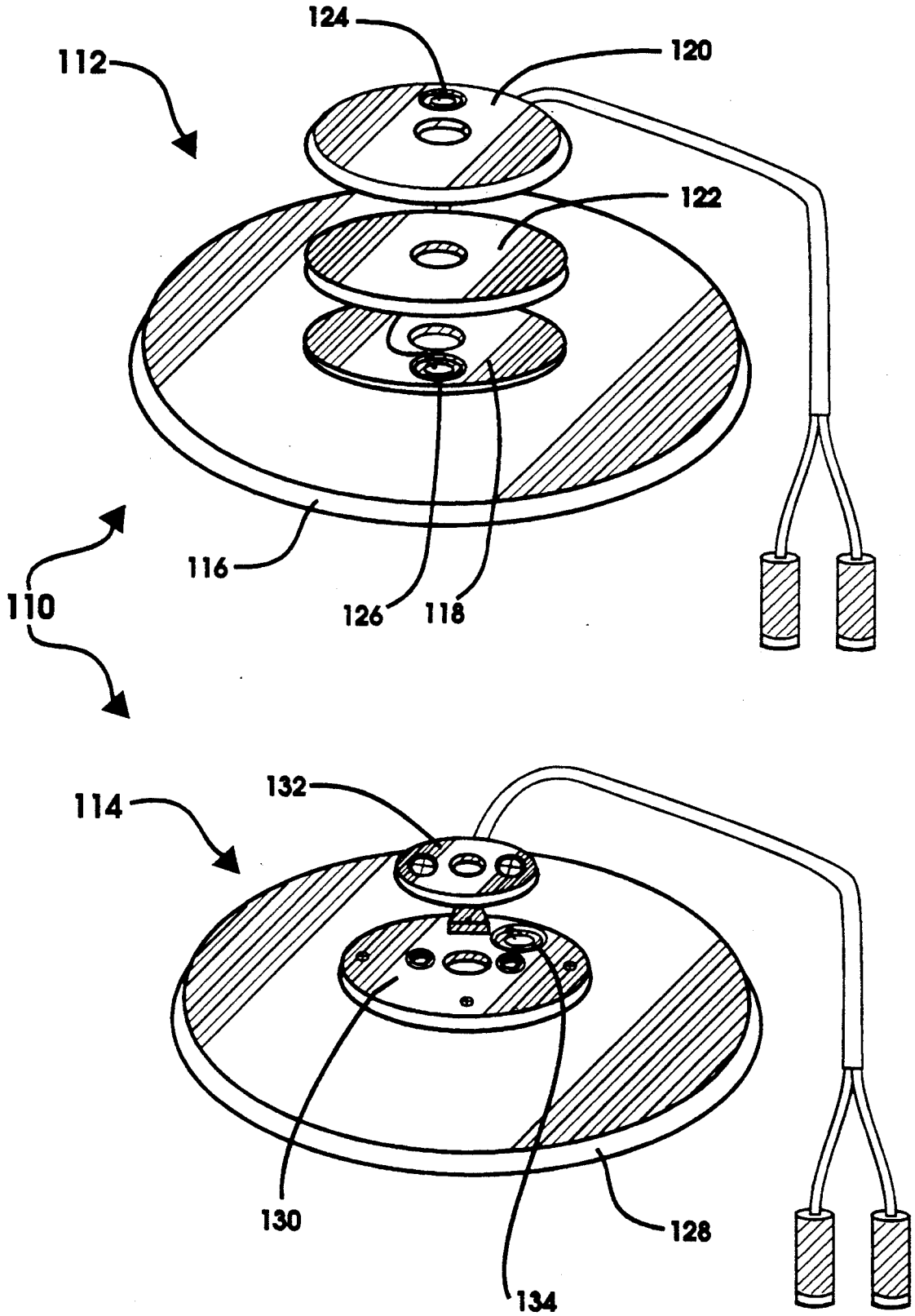
FIG. 6*a* is an exploded angled side perspective of another embodiment of the present invention, illustrating its use as an electronic hi-hat cymbal system, shown in its normal upright playing position.

Referring now to FIG. 6*a*, an exploded perspective view of electronic cymbal system, designated generally as 110, is provided, for simulating the playing feel of a pair of acoustic hi-hat cymbals. Hi-hat system 110 may be mounted on commercially available hi-hat stands.

Hi-hat cymbal system 110 includes a top hi-hat cymbal, designated as 112 and a bottom hi-hat cymbal, designated as 114. Top hi-hat cymbal 112 comprises a large, lower cymbal member 116, a small intermediate 118 affixed thereto, a small upper cymbal member 120, and a neoprene isolator pad 122 mounted between members 118 and 120. These elements 116, 118, 120, 122 are securely sandwiched by appropriate adhesives. A pressure transducer 124 is mounted within a countersunk circular opening in the bottom surface of upper cymbal member 120. A second pressure transducer 126 is mounted within a hole in the intermediate cymbal member 118.

Figure 6B:
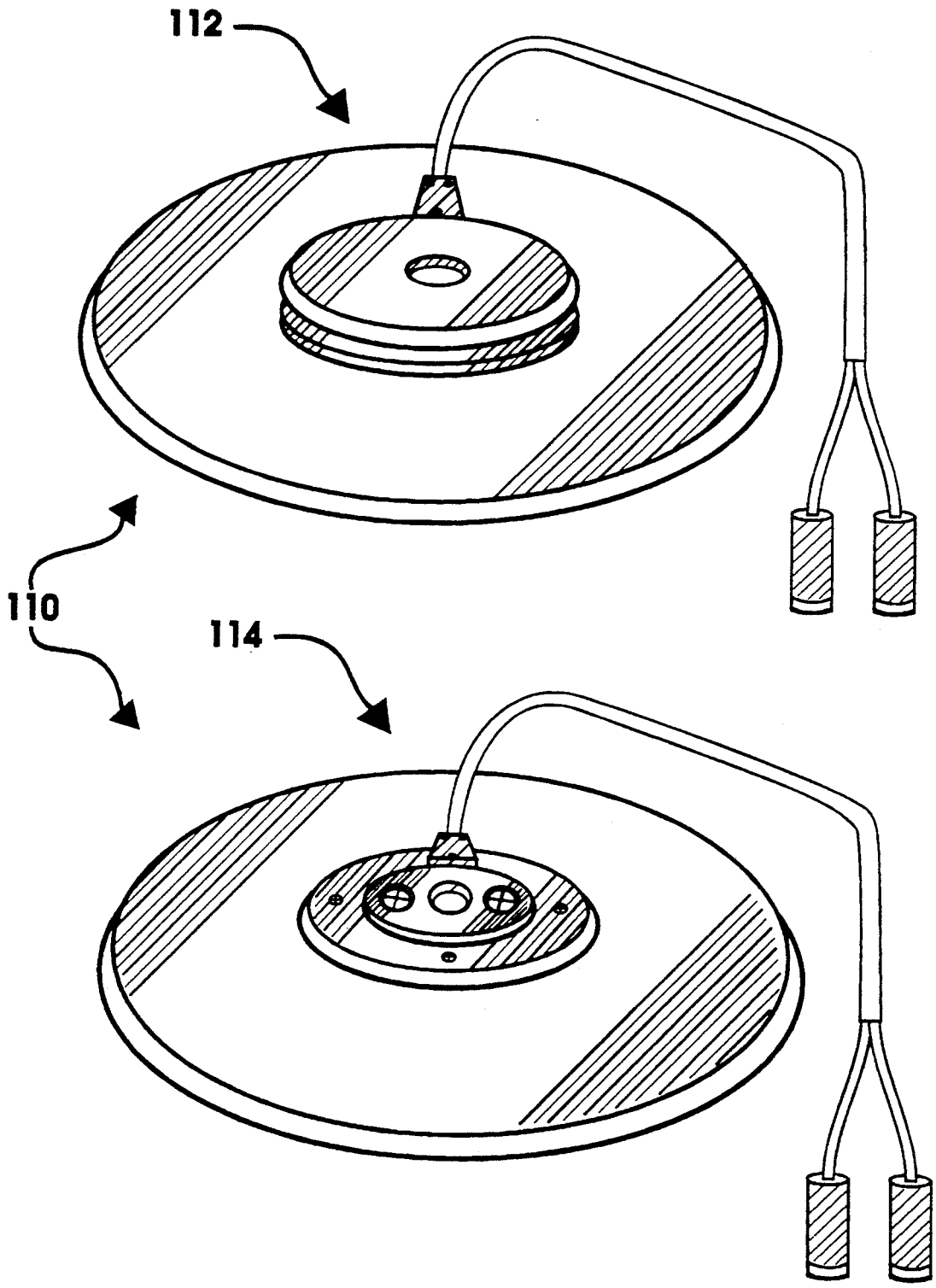
FIG. 6*b* shows the embodiment of FIG. 6*a* in an un-exploded view.

Bottom hi-hat cymbal member 114 comprises a large, lower cymbal member 128, small upper cymbal member 130, and a seat adaptor 132. Elements 128, 130, and 132 are securely sandwiched by appropriate fasteners. A pressure transducer 134 is mounted within a countersunk circular opening in the bottom surface of cymbal member 130. Seat adapter 132 is necessary to assure proper pressure-fitting onto bottom hi-hat cymbal seat spindles made by various manufacturers of hi-hat stands. FIG. 6*b* illustrates a constructed view of the cymbal system of FIG. 6*a*.

Figure 6C:
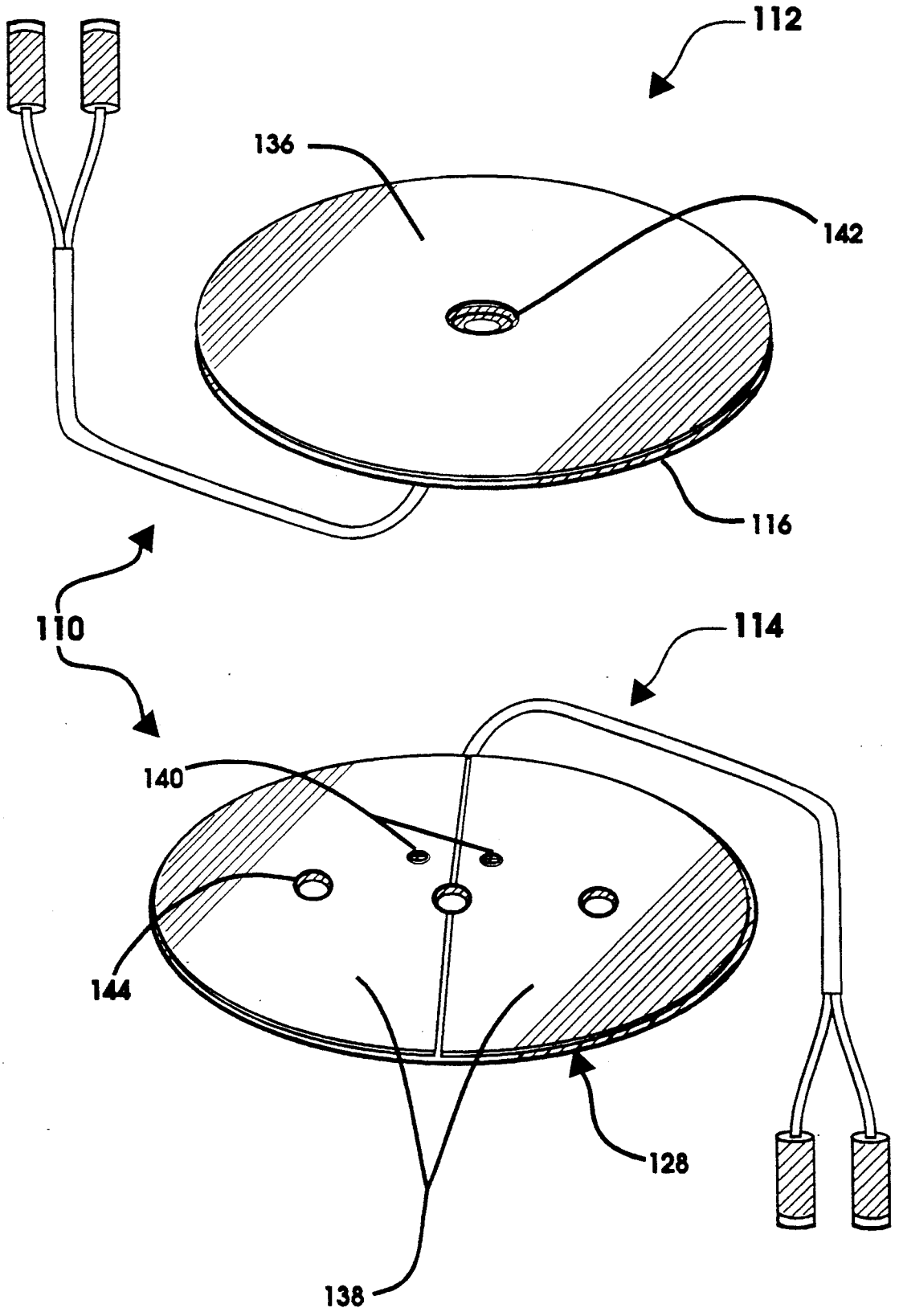
FIG. 6*c* is a view of FIG. 6*a* and 6*b* embodiment in an inverted position to show another embodiment of the choke mechanism of the present invention.
Figure 6D:
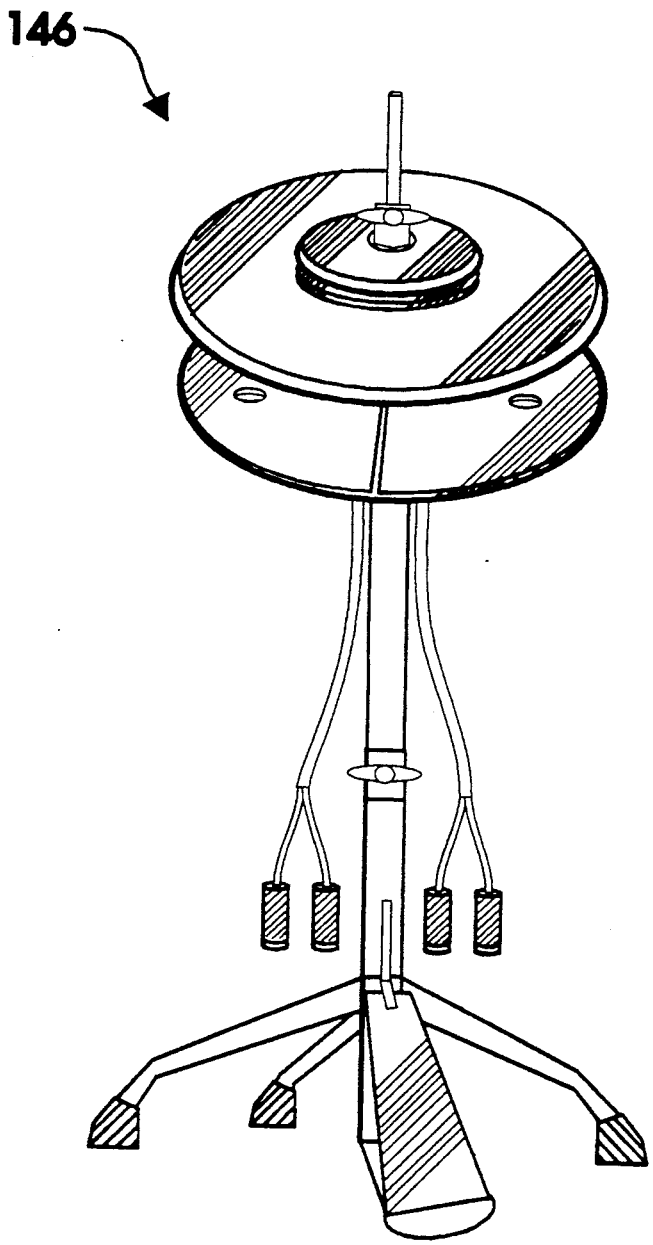
FIG. 6*d* is a view of the 6*a* and 6*b* embodiment mounted in playing position on a conventional hi-hat stand.

Referring now to FIG. 6*c* the cymbal system of FIGS. 6*a* and 6*b* is shown with both the top hi-hat 112 and bottom hi-hat 114 inverted. The bottom surface of the top hi-hat 112 contains a conductive element 136 mounted thereon. The bottom surface of the bottom hi-hat 114 contains two spaced conductive elements 138. Appropriate choke circuit connections 140 are connected to each of the conductive elements 138. Thus, when the upper and lower electronic cymbals 112, 114 are brought into contact, an electrical bridging is formed between conductive elements 138. Hence, appropriate MIDI choke/send signals are effected by the MIDI interface system in the same manner as described above with reference to the previous embodiments. In effect, the conductive element 136, replaces the user's hand in providing the choke response. The upper and lower cymbals 112, 114 meet through the pedal actuated mechanical operation of a conventional spring-loaded hi-hat stand, designated generally as 146, in FIG. 6*d*. A center hole 142 allows for flush mounting of a top hi-hat mount nut. Air holes 144 are provided so as to ventilate air resistance pressure that is present between the top and bottom hi-hats when they are in motion, percussively meeting each other on a hi-hat stand.

Figure 7:
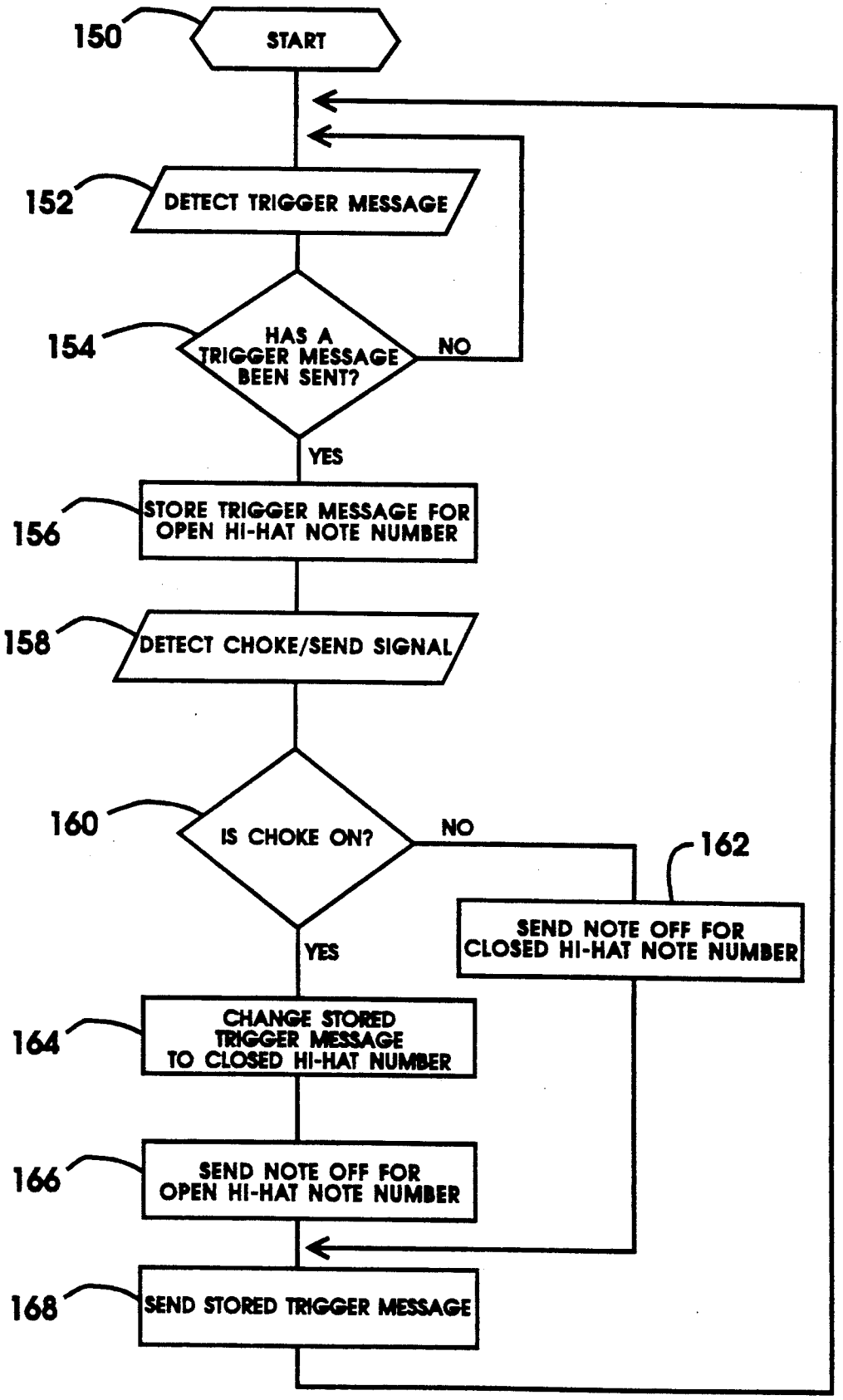
FIG. 7 is is a flow chart illustrating the manner in which the MIDI interface system interprets digital choke/send messages for the FIG. 6 embodiment.

Referring now to FIG. 7, an algorithm is shown, illustrating the manner in which the MIDI interface system 21 interprets digital choke/send messages in response to trigger messages sent from the pad interface, for the hi-hat embodiment of FIG. 6. At start (block 150) the software code is waiting for stimulus in the form of detecting a note on or trigger message (block 152). The code then checks to see if a trigger message has been sent (block 154). If a trigger message has not been sent, the code returns to start. If a trigger message has been sent, the trigger message is stored (block 156) in reference to a corresponding, user assignable open hi-hat MIDI note number. The code then detects any incoming choke/send signals (block 158) and checks to see if they are on (block 160). If the choke/send signal is not on, the code sends a note off message corresponding to a user assignable closed hi-hat note number (block 162) and then sends the previously stored trigger message. If a choke/send signal is on, the code changes the previously stored trigger message for the opened hi-hat number to the closed hi-hat number (block 164) and then sends a MIDI note off corresponding to the open hi-hat note number (block 166) and then sends the previously stored trigger message (block 168).

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. An electronic cymbal system, comprising:

a) a cymbal member mountable on a cymbal stand, said cymbal member having a playing feel approximating that of a conventional cymbal;

b) a transducer affixed to a surface of said cymbal member for translating any substantial percussive impact on the cymbal member to electrical signals;

c) at least one conductive element mounted on said cymbal member; and d) a MIDI interface system, including:

i) means for converting said electrical signals into MIDI note-on messages serving as trigger messages;

ii) means for alternating an electrical signal between two stable states in response to a user's manipulation of said at least one conductive element, each stable state representing a digital signal; and, iii) a software system for recognizing and then interpreting said digital signal into MIDI note off and note on messages, serving as MIDI choke/-send messages, said trigger messages and said choke/send messages being sent out via a MIDI connection to an external tone generating device.

2. The electronic cymbal system of claim 1, wherein said at least one conductive element comprises a first conductive element and a second conductive element, each mounted in positions separate from each other on said cymbal member, said MIDI interface system being so arranged and constructed to cooperate with said first and second conductive elements so that when said conductive elements are electrically bridged by a third conductive element serving as a switch to close an electric circuit therebetween, changes in voltage levels are generated which are translated into said digital choke/-send messages, said digital choke/send messages being software recognition interpreted into MIDI choke/send messages as note-off and/or note/on data.

3. The electronic cymbal system of claim 2, wherein said first conductive element and said second conductive element are positioned at locations easily accessible to the user's touch, said third conductive element comprising a user's hand, such that when a user bridges said first and second conductive elements with his touch, the decay time of a tone generated by said system is choked-off, as in a "note off", before said tone reaches the end of its full and normal decay period.

4. The electronic cymbal system of claim 2, wherein said first conductive element and said second conductive element are positioned at locations easily accessible to the user's touch, said third conductive element comprising a user's hand, such that when a user bridges said first and second conductive elements with his touch, a tone can be "played" as in a note on.

5. The electronic cymbal system of claim 2, wherein said first conductive element is disposed at a position adjacent to at least a portion of the outer periphery of said cymbal and said second conductive element is positioned slightly separately from said first element and interiorly therefrom.

6. The electronic cymbal system of claim 2, wherein said cymbal member comprises a first conventionally sized resilient disc, said cymbal system further including, a) a second semi-rigid resilient disc mounted on said conventionally sized semi-rigid resilient disc, said second semi-rigid resilient disc having a diameter approximating that of a bell portion of a conventional cymbal; and, b) a second transducer affixed to a surface of said second disc for translating any percussive impact on said second disc to electrical signals, said signals being used to trigger sounds from an external tone generating device; and, c) means for acoustically isolating said second transducer from the sound pickup device located on said conventionally sized semi-rigid resilient disc, said second resilient disc emulating the feel and positioning of the bell portion of a conventional cymbal.

7. The electronic cymbal system of claim 6, wherein said means for acoustically isolating said second transducer from the transducer located on said conventionally sized semi-rigid resilient disc includes a neoprene rubber pad disposed between said second resilient disc and said conventionally sized resilient disc.

8. The electronic cymbal system of claim 2, wherein said cymbal member comprises a conventionally sized semi-rigid resilient disc and forms a first electronic cymbal of a pair of electronic hi-hat cymbals, said first electronic cymbal having said third conductive element mounted thereon, said cymbal system further comprising a second electronic cymbal of said pair of electronic hi-hat cymbals, said second electronic cymbal having said first and second conductive elements mounted thereon, so that when said first and second electronic cymbals are brought into contact, said third conductive element closes said electric circuit between said first and second conductive elements, said second electronic cymbal being formed of:

a second semi-rigid resilient disc having said first and second conductive elements disposed on a surface thereof, a switch being actuatable when said first and second electronic cymbals are brought into contact, said switch triggering alternating tones.

9. The electronic cymbal system of claim 1, wherein said transducer comprises a piezo-electric transducer.

10. The electronic cymbal system of claim 1, wherein said cymbal member comprises a semi-rigid disc having a diameter approximating that of a conventional cymbal.

11. The electronic cymbal system of claim 1, wherein said means for alternating said electrical signal between two stable states, comprises a ground referenced floating switch, including:

a) a first contact connected to said first conductive element, said first contact having the same potential as ground;

b) a second contact connected to said second conductive element;

c) a buffering amplifier having an input and an output;

d) low impedance resistance means connected in series between said second contact and said buffering amplifier input;

e) a power supply; and f) high impedance resistance means connected in series between said power supply and said buffering amplifier input, the output of said buffering amplifier being directed to said software system.

12. The electronic cymbal system of claim 1 wherein said MIDI interface system interprets said digital choke/send messages by a process comprising the steps of:

a) detecting whether a trigger message has been sent;

b) incrementing a note-on-sent flag;

c) detecting whether a choke/send signal is present;

d) returning to step (a) if the choke/send signal is not on;

e) returning to step (a) if note-on-sent flag(s) are not on;

f) sending a corresponding MIDI note off if note-on-sent flag is on;

g) decrementing the note-on-sent flag; and, j) returning to step (e) to determine whether any note-on-sent flags are still on, thereby allowing for polyphonic triggering of note-on and note-off information.

13. An electronic cymbal system, comprising:

a) a cymbal member mountable on a cymbal stand, said cymbal member having a playing feel approximating that of a conventional cymbal;

b) a transducer affixed to a surface of said cymbal member for translating any substantial percussive impact on the cymbal member to electrical signals, c) means for converting said electrical signals into MIDI note on messages serving as trigger messages;

d) a first conductive element and a second conductive element, each mounted in positions separate from each other on said cymbal member; and, e) a MIDI interface system, so arranged and constructed to cooperate with said first and second conductive elements so that when said conductive elements are electrically bridged by a third conductive element serving as a switch to close an electric circuit therebetween, changes in voltage levels are generated which are translated into digital choke/send signals, said digital choke/send signals being software recognition interpreted into MIDI choke/send messages as note off and/or "note on" data, said trigger messages and said choke/send messages being sent out via a MIDI connection to an external tone generating device.

14. An electronic cymbal for an electronic cymbal system of the type including means for converting electrical signals into MIDI note on messages serving as trigger messages and having a MIDI interface system, said MIDI interface system including: (a) means for alternating an electrical signal between two stable states in response to a user's manipulation of at least one conductive element, each stable state representing a digital signal, and (b) a software system for recognizing and interpreting said digital signal into MIDI note off and/or note on messages serving as MIDI choke/send messages, said electronic cymbal comprising:

a) a cymbal member mountable on a cymbal stand, said cymbal member having a playing feel approximating that of a conventional cymbal;

b) a transducer affixed to a surface of said cymbal member for translating any substantial percussive impact on the cymbal member to electrical signals; and c) at least one conductive element mounted on said cymbal member being so manipulatable by said user so as to alternate said electrical signal between two stable states.

15. An electronic cymbal system, comprising:

a) a member for use as a cymbal member mountable on a cymbal stand;

b) a transducer affixed to a surface of said cymbal member for translating any substantial percussive impact on the cymbal member to electrical signals;

c) at least one conductive element mounted on said cymbal member; and d) a MIDI interface system, including:

i) means for converting said electrical signals into MIDI note-on messages serving as trigger messages;

ii) means for providing changes in voltage levels in response to a user's manipulation of said at least one conductive element; and, iii) a software system for recognizing and then interpreting said changes in voltage levels into MIDI note off and note on messages, serving as MIDI choke/send messages, said trigger messages and said choke/send messages being sent out via a connection to an external tone generating device.

* * * * *